US009625233B2

(12) United States Patent
Daniel et al.

(10) Patent No.: US 9,625,233 B2
(45) Date of Patent: Apr. 18, 2017

(54) RUBBER PANEL ATTACHABLE TO A RAIL SYSTEM OF A FIREARM

(71) Applicant: Daniel Defense, Inc., Black Creek, GA (US)

(72) Inventors: Marvin C. Daniel, Pooler, GA (US); Larry J R Jones, Monroe, GA (US)

(73) Assignee: Daniel Defense, Inc., Black Creek, GA (US)

( * ) Notice: Subject to any disclaimer, the term of this patent is extended or adjusted under 35 U.S.C. 154(b) by 0 days.

(21) Appl. No.: 14/886,649

(22) Filed: Oct. 19, 2015

(65) Prior Publication Data

US 2016/0116246 A1 Apr. 28, 2016

Related U.S. Application Data

(60) Provisional application No. 62/069,666, filed on Oct. 28, 2014.

(51) Int. Cl.

| | |
|---|---|
| ***F41C 27/00*** | (2006.01) |
| ***F41C 23/16*** | (2006.01) |
| ***F41G 11/00*** | (2006.01) |

(52) U.S. Cl.

CPC ..... *F41C 23/16* (2013.01); *F41G 11/003* (2013.01)

(58) Field of Classification Search

CPC ..... F41A 35/02; F41C 23/16

See application file for complete search history.

(56) References Cited

U.S. PATENT DOCUMENTS

| | | | | |
|---|---|---|---|---|
| 7,823,319 | B2 * | 11/2010 | Casas Salva | F41A 35/02 42/71.01 |
| 9,222,749 | B1 * | 12/2015 | Nakayama | F41C 23/16 |
| 2012/0085013 | A1 * | 4/2012 | Cahill | F41A 35/02 42/96 |
| 2012/0167434 | A1 * | 7/2012 | Masters | F41C 23/16 42/90 |
| 2012/0311906 | A1 * | 12/2012 | Troy | F41C 23/16 42/71.01 |
| 2013/0326925 | A1 * | 12/2013 | Power | F41C 23/16 42/71.01 |
| 2014/0157639 | A1 * | 6/2014 | Larson, Jr. | F41C 23/16 42/71.01 |
| 2014/0325889 | A1 * | 11/2014 | Michal | F41G 11/003 42/75.01 |
| 2015/0096215 | A1 * | 4/2015 | Somogy | F41C 23/16 42/71.01 |
| 2015/0128470 | A1 * | 5/2015 | Troy, Jr. | F41C 23/16 42/90 |
| 2016/0169610 | A1 * | 6/2016 | Hines | F41C 27/00 42/90 |

* cited by examiner

*Primary Examiner* — Gabriel Klein

(74) *Attorney, Agent, or Firm* — Eversheds Sutherland (US) LLP

(57) ABSTRACT

A rubber panel attachable to a rail system of a firearm is disclosed herein. The rubber panel may include an elongated body comprising a first side, a second side, an upper edge, a lower edge, a first end, and a second end. The rubber panel also may include a gripping surface disposed on the first side of the elongated body. Moreover, the rubber panel may include at least one attachment protrusion disposed on the second side of the elongated body.

12 Claims, 4 Drawing Sheets

RUBBER PANEL ATTACHABLE TO A RAIL SYSTEM OF A FIREARM

CROSS-REFERENCE TO RELATED APPLICATIONS

The disclosure claims priority to and the benefit of U.S. provisional application No. 62/069,666, filed Oct. 28, 2014, which is herein incorporated by reference in its entirety.

FIELD OF THE DISCLOSURE

The disclosure generally relates to firearm accessories and more particularly relates to a rubber panel attachable to a rail system of a firearm.

BACKGROUND

Panels are typically made with hard plastic. Hard plastic, however, may not provide an adequate gripping surface. Moreover, hard plastic panels require a separate mechanical fastener for attachment to a rail system of a firearm.

SUMMARY

Some or all of the above needs and/or problems may be addressed by certain embodiments of a rubber panel attachable to a rail system of a firearm disclosed herein. In certain embodiments, the rubber panel may include an elongated body comprising a first side, a second side, an upper edge, a lower edge, a first end, and a second end. The rubber panel also may include a gripping surface disposed on the first side of the elongated body. Moreover, the rubber panel may include at least one attachment protrusion disposed on the second side of the elongated body.

Other features and aspects of the rubber panel will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
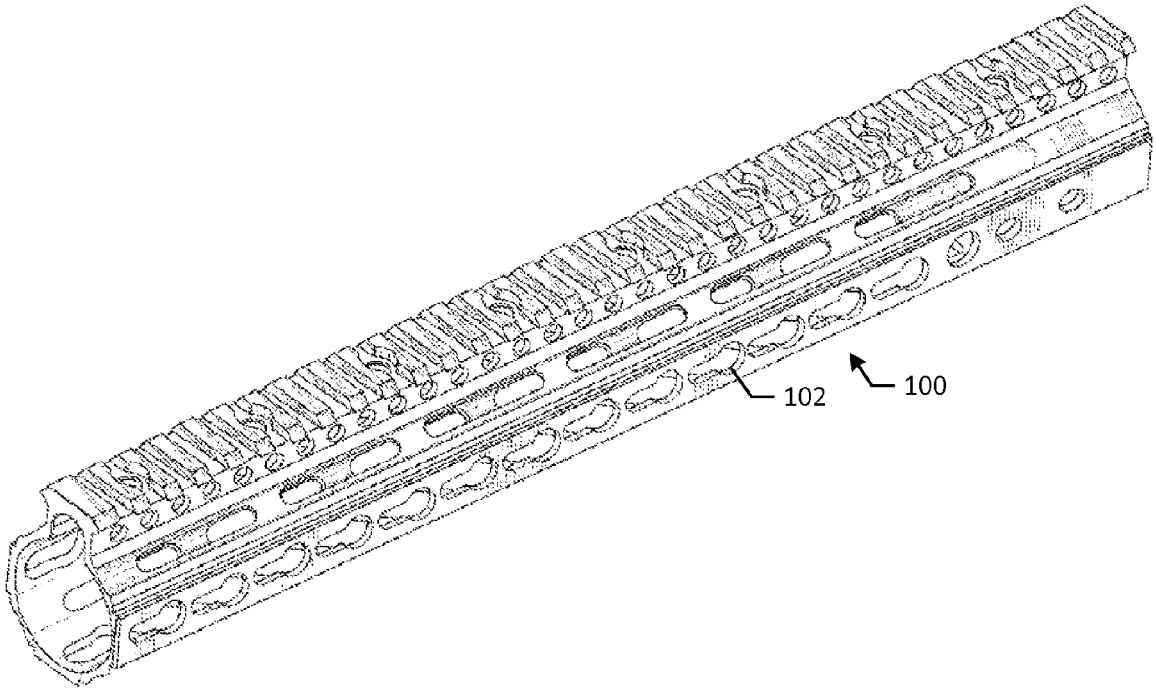
FIG. 1 depicts a rail system in accordance with one or more embodiments of the disclosure.

Described below are embodiments of a rubber panel attachable to a rail system of a firearm. Methods of manufacturing, using, and installing the rubber panel are also disclosed. The firearm may be a conventional firearm. For example, the firearm may be an M-16 style rifle, an AR-15 style rifle, an AR-10 style rifle, or an M-4 style rifle, among others. Any type of firearm (including rifles, handguns, shotguns, or the like) may be used. The rail system may comprise a KeyMod rail system, an M-LOK rail system, a Picatinny rail system, a MOE slot rail system, or the like. Any type of rail system may be used.

Generally speaking, the rubber panel may include an elongated body comprising a first side, a second side, an upper edge, a lower edge, a first end, and a second end. The rubber panel also may include a gripping surface disposed on the first side of the elongated body. Moreover, the rubber panel may include at least one attachment protrusion disposed on the second side of the elongated body.

In certain embodiments, the at least one attachment protrusion may comprise a first portion and a second portion. In some instances, the first portion and the second portion of the at least one attachment protrusion may collectively form a substantially keyhole-shaped protrusion. The substantially keyhole-shaped protrusion may be configured to mate with a keyhole of a KeyMod rail system or the like. For example, the first portion of the at least one attachment protrusion may be substantially rectangular, and the second portion of the at least one attachment protrusion may be substantially circular. In some instances, the first portion of the at least one attachment protrusion may include a lip. For example, the first portion of the at least one attachment protrusion may have a substantially hexagonal cross-section, which forms the lip. In addition, in some instances, the second portion of the at least one attachment protrusion may include a chamfered edge.

In another embodiment, the at least one attachment protrusion may include a rectangle with rounded corners. In addition, the at least one attachment protrusion may include a continuous lip. The rectangle with rounded corners and the continuous lip may be configured to mate with a slot in an M-LOK rail system or the like.

In some instances, the upper edge of the elongated body may include an upper curved lip. Likewise, the lower edge of the elongated body may include a lower curved lip. The upper and lower curved lips may be curved towards the rail system when attached thereto. That is, the upper and lower curved lips may be at least partially curved about the at least one attachment protrusion. In some instances, the first end of the elongated body, the second end of the elongated body, or both may be rounded.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

Figure 2:
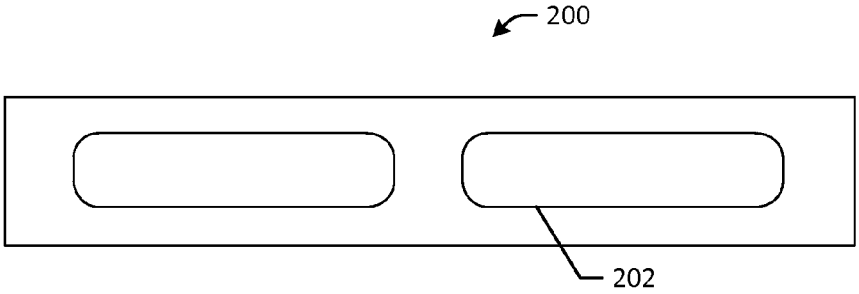
FIG. 2 depicts a rail system in accordance with one or more embodiments of the disclosure.
Figure 3:
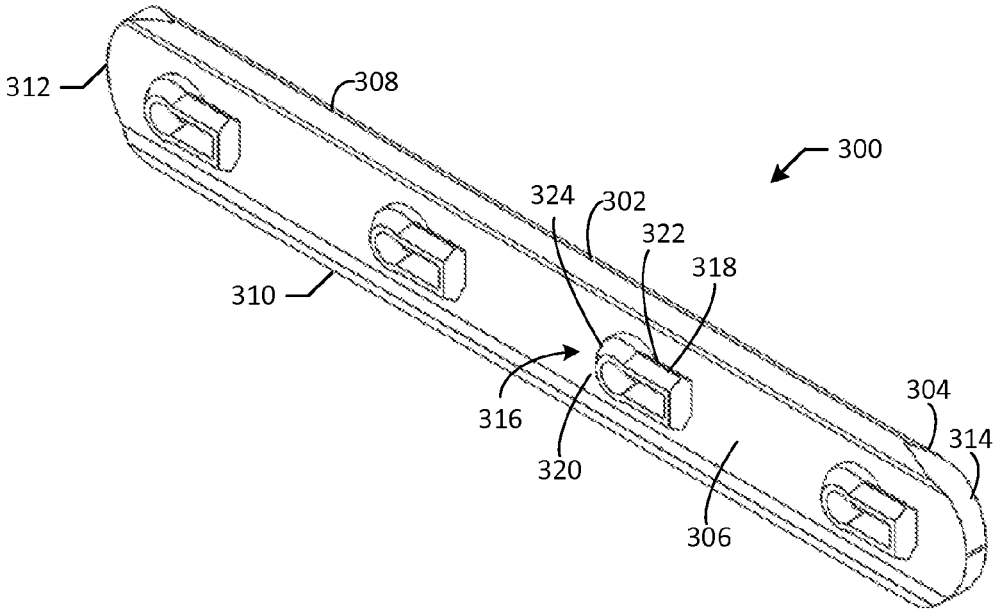
FIG. 3 depicts a rubber panel attachable to a rail system of a firearm in accordance with one or more embodiments of the disclosure.
Figure 4:
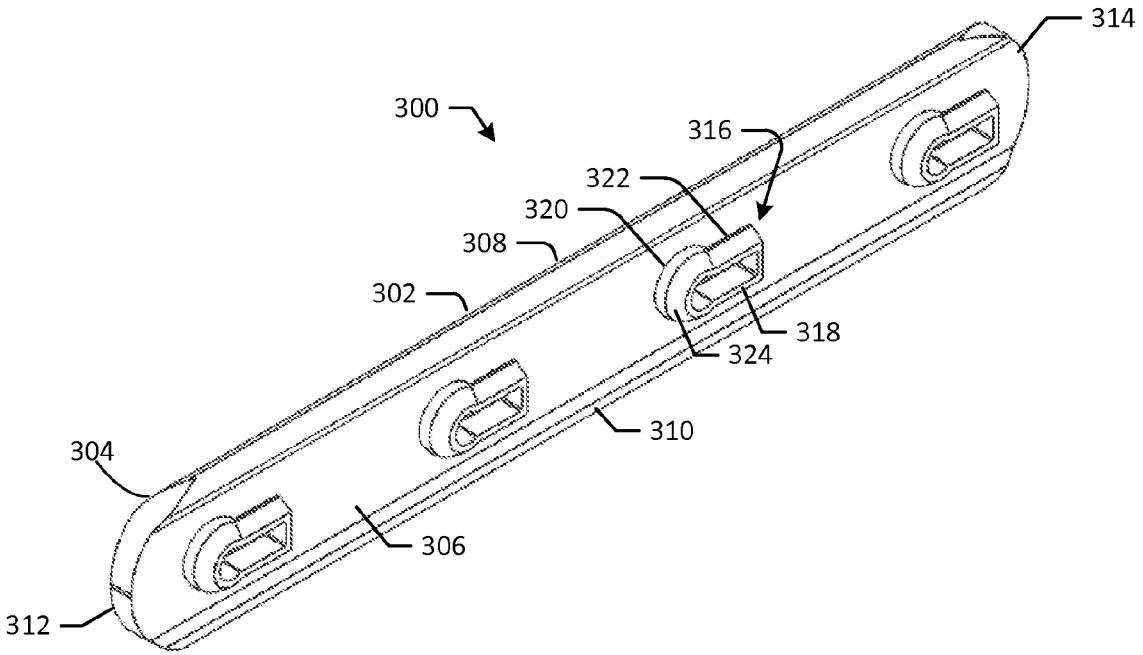
FIG. 4 depicts a rubber panel attachable to a rail system of a firearm in accordance with one or more embodiments of the disclosure.
Figure 5:
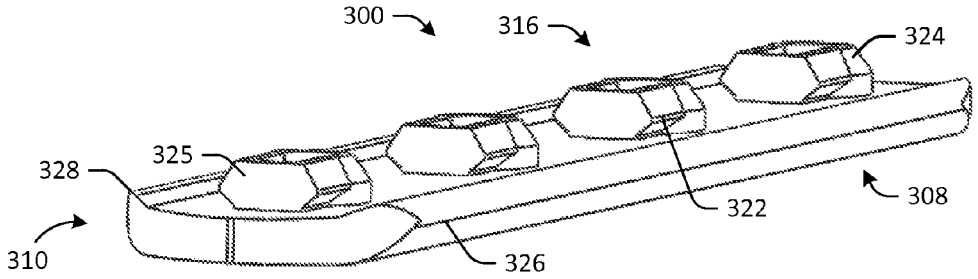
FIG. 5 depicts a rubber panel attachable to a rail system of a firearm in accordance with one or more embodiments of the disclosure.
Figure 6:
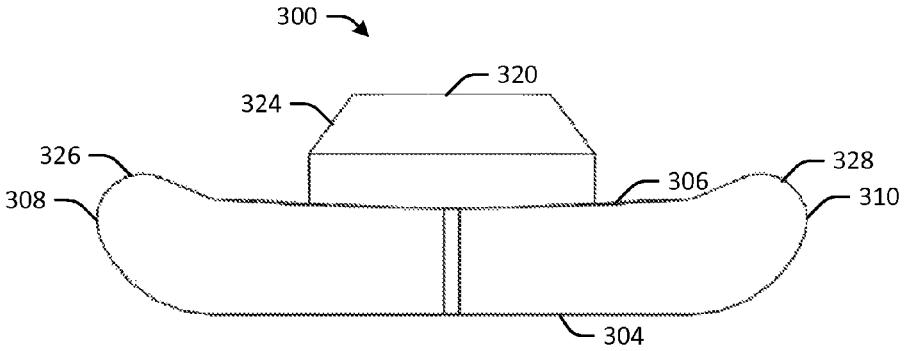
FIG. 6 depicts a rubber panel attachable to a rail system of a firearm in accordance with one or more embodiments of the disclosure.
Figure 7:
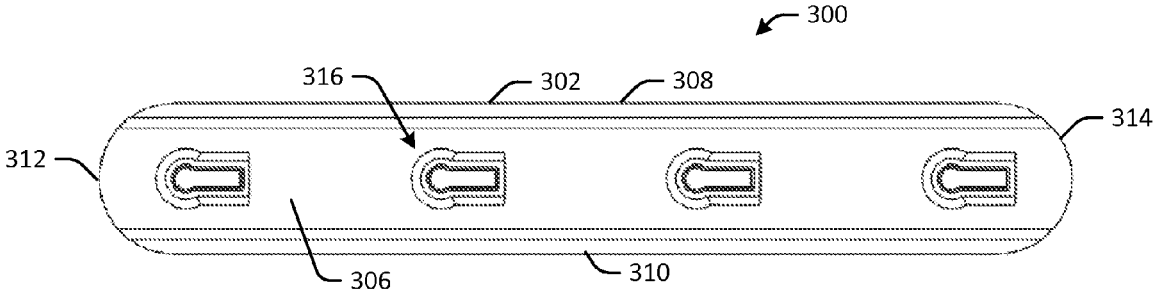
FIG. 7 depicts a rubber panel attachable to a rail system of a firearm in accordance with one or more embodiments of the disclosure.

FIGS. 1 and 2 depict example embodiments of various rail systems for attaching firearm accessories to a firearm. The firearm may be a conventional firearm. For example, the firearm may be an M-16 style rifle, an AR-15 style rifle, an AR-10 style rifle, or an M-4 style rifle, among others. Any type of firearm (including rifles, handguns, shotguns, or the like) may be used. The rail system may comprise a KeyMod rail system, an M-LOK rail system, a Picatinny rail system, a MOE slot rail system, or the like. Any type of rail system, or combination of rail systems, may be used.

FIG. 1 depicts a KeyMod rail system 100. The KeyMod rail system 100 may include a number of keyholes 102 for the attachment of firearm accessories. FIG. 2 partially depicts an M-LOK rail system 200. The M-LOK rail system 200 may include a number of slots 202 for the attachment of firearm accessories. The slots 202 may comprise rectangular openings with rounded corners. Other types of rail assemblies may be used.

FIGS. 3-7 depict a rubber panel 300 attachable to a rail system of a firearm. The rubber panel 300 may include an elongated body 302 comprising a first side 304, a second side 306, an upper edge 308, a lower edge 310, a first end 312, and a second end 314. The rubber panel 300 may include a gripping surface disposed on the first side 304 of the elongated body 302. The gripping surface may include a texturized surface, a smooth surface, or a combination thereof. Moreover, the rubber panel 300 may include at least one attachment protrusion 316 disposed on the second side 306 of the elongated body 302. The at least one protrusion 316 may be a solid piece formed integrally with the elongated body 302. In other instances, the at least one protrusion 316 may include a cavity such that it is partially hollow. In some instances, the at least one attachment protrusion 316 may comprise a number of attachment protrusions 316 aligned along a central axis of the rubber panel 300. Any number of attachment protrusions 316 may be used. The attachment protrusions 316 may be disposed at any location on the rubber panel 300.

In certain embodiments, the at least one attachment protrusion 316 may comprise a first portion 318 and a second portion 320. In some instances, the first portion 318 and the second portion 320 of the at least one attachment protrusion 316 may collectively form a substantially keyhole-shaped protrusion. The substantially keyhole-shaped protrusion may be configured to mate with the keyholes 102 in the KeyMod rail system 100 of FIG. 1. For example, the first portion 318 of the at least one attachment protrusion 316 may be substantially rectangular, and the second portion 320 of the at least one attachment protrusion 316 may be substantially circular. In some instances, the first portion 318 of the at least one attachment protrusion 316 may include a lip 322. For example, the first portion 318 of the at least one attachment protrusion 316 may have a substantially hexagonal cross-section 325, which forms the lip 322. The lip 322 may be pressed into the keyhole 102 of the KeyMod rail system 100 in FIG. 1 and secure the rubber panel 300 thereto. For example, the lip 322 may fit under a ledge in the rail system, similar to a grommet, to secure the rubber panel 300 thereto. The second portion 320 of the at least one attachment protrusion 316 may not include a lip. However, in other instances, the lip 322 may be disposed about the first portion 318 of the at least one attachment protrusion 316, the second portion 320 of the at least one attachment protrusion 316, or a combination thereof. In some instances, the second portion 320 of the at least one attachment protrusion 316 may include a chamfered edge 324.

In some instances, the upper edge 308 of the elongated body 302 may include an upper curved lip 326. Likewise, the lower edge 310 of the elongated body 302 may include a lower curved lip 328. The upper curved lip 326 and the lower curved lip 328 may be curved towards the rail system when attached thereto. That is, the upper curved lip 326 and the lower curved lip 328 may be at least partially curved towards and about the at least one attachment protrusion 316. In this manner, the rubber panel 300 may rest flush against the rail when attached thereto. In some instances, the first end 312 of the elongated body 302, the second end 314 of the elongated body 302, or both may be rounded.

Figure 8:
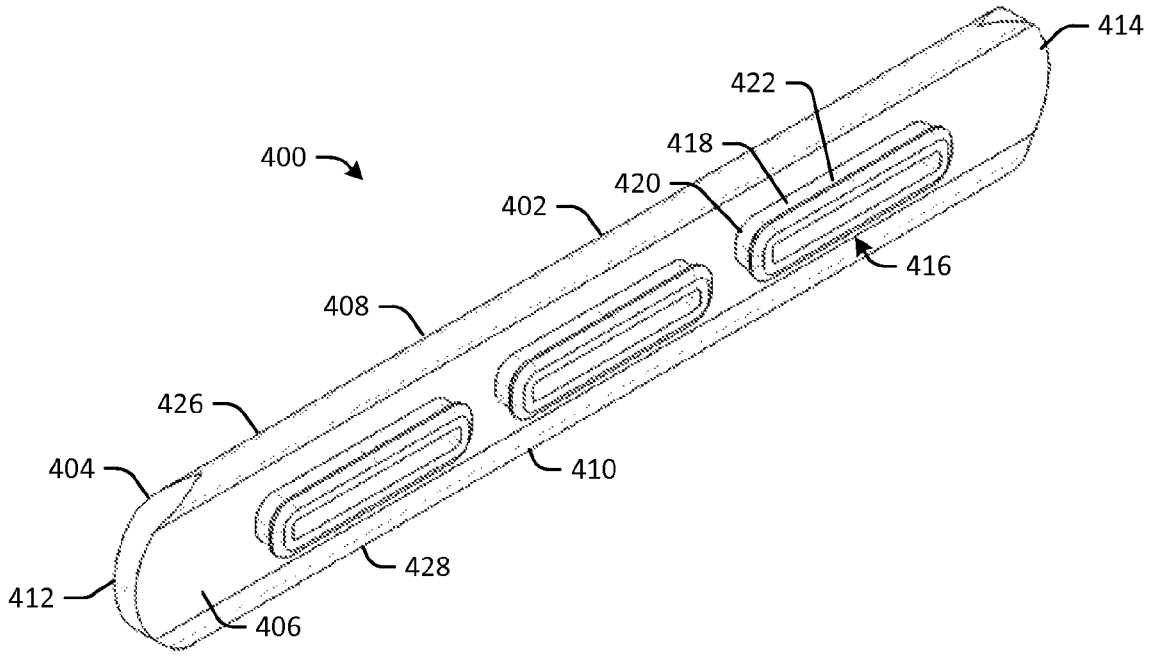
FIG. 8 depicts a rubber panel attachable to a rail system of a firearm in accordance with one or more embodiments of the disclosure.
Figure 9:
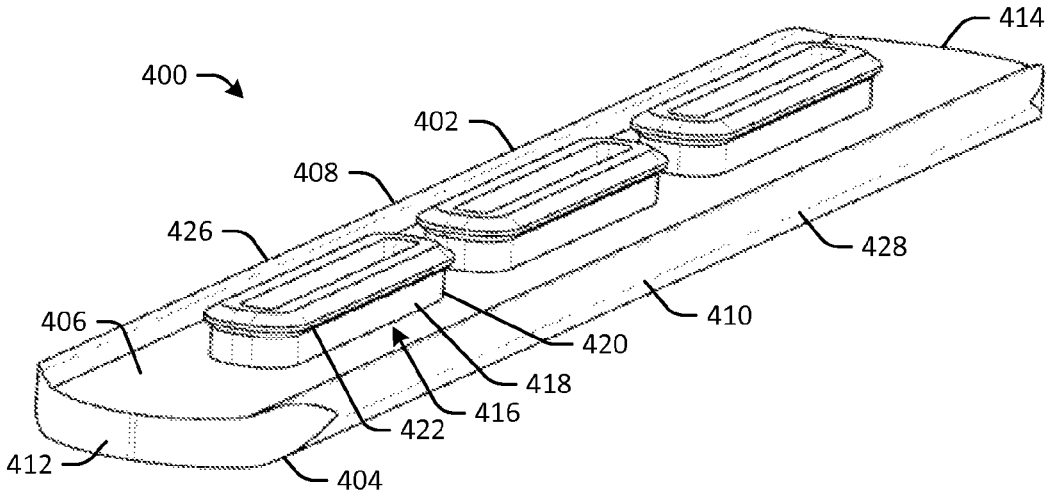
FIG. 9 depicts a rubber panel attachable to a rail system of a firearm in accordance with one or more embodiments of the disclosure.

FIGS. 8 and 9 schematically depict a rubber panel 400 attachable to a rail system of a firearm. The rubber panel 400 may include an elongated body 402 comprising a first side 404, a second side 406, an upper edge 408, a lower edge 410, a first end 412, and a second end 414. The rubber panel 400 may include a gripping surface disposed on the first side 404 of the elongated body 402. The gripping surface may include a texturized surface, a smooth surface, or a combination thereof. Moreover, the rubber panel 400 may include at least one attachment protrusion 416 disposed on the second side 406 of the elongated body 402. The at least one protrusion 416 may be a solid piece formed integrally with the elongated body 402. In other instances, the at least one protrusion 416 may include a cavity such that it is partially hollow. In some instances, the at least one attachment protrusion 416 may comprise a number of attachment protrusions 416 aligned along a central axis of the rubber panel 400. Any number of attachment protrusions 416 may be used. The attachment protrusions 416 may be disposed at any location on the rubber panel 400.

In certain embodiments, the at least one attachment protrusion 416 may include a rectangle 418 with rounded corners 420. In addition, the at least one attachment protrusion 416 may include a continuous lip 422. The continuous lip 422 may be spaced apart from the second side 406 of the elongated body by the rectangle 418 with rounded corners 420. The rectangle 418 with rounded corners 420 and the continuous lip 422 may be configured to mate with the slot 202 in the M-LOK rail system 200 in FIG. 2. For example, the continuous lip 422 may be pressed into the slot 202 in the M-LOK rail system 200 in FIG. 2 and secure the rubber panel 400 thereto. In this manner, the continuous lip 422 may fit under a ledge in the rail system, similar to a grommet, to secure the rubber panel 400 thereto.

In some instances, the upper edge 408 of the elongated body 402 may include an upper curved lip 426. Likewise, the lower edge 410 of the elongated body 402 may include a lower curved lip 428. The upper curved lip 426 and the lower curved lip 428 may be curved towards the rail system when attached thereto. That is, the upper curved lip 426 and the lower curved lip 428 may be at least partially curved towards and about the at least one attachment protrusion 416. In this manner, the rubber panel 400 may rest flush against the rail when attached thereto. In some instances, the first end 412 of the elongated body 402, the second end 414 of the elongated body 402, or both may be rounded.

In both embodiments, the rubber panel provides additional grip to a user. For example, the rubber panels may comprise a soft rubber or the like that has superior gripping surfaces compared to that of a hard plastic panel. In addition, by not having a separate mechanical fastener, the cost of producing the rubber panel is reduced. Moreover, the rubber panel may insulate the user from heat created from firing the firearm.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A rubber panel attachable to keyholes of a rail system of a firearm, the rubber panel comprising:

an elongated body comprising a first side, a second side, an upper edge, a lower edge, a first end, and a second end;

a gripping surface disposed on the first side of the elongated body; and a plurality of attachment protrusions disposed on the second side of the elongated body, with each attachment protrusion comprising a first portion having a lesser width dimension in plan view and a second portion having a greater width dimension in plan view, the first and second portions being upwardly extending and disposed around the entire perimeter of a respective attachment protrusion for mating engagement with the rail system of the firearm;

the first and second portions having inwardly deformable inner and outer surfaces, and having inwardly tapered guide surfaces disposed on the outer surfaces thereof, thereby to guide the respective attachment protrusion into a respective keyhole and to facilitate insertion and attachment of the respective attachment protrusion to the rail system; and the first portion of the respective attachment protrusion having a securement lip unitarily formed with the inwardly tapered guide surfaces and laterally extending from the first portion of the respective attachment protrusion for mating and gripping engagement with the respective keyhole of the rail system upon insertion of the respective attachment protrusion thereinto.

2. The rubber panel of claim 1, wherein the first portion and the second portion of each attachment protrusions collectively form a substantially keyhole-shaped protrusion which comprise a rounded portion connected to a substantially rectangular portion.

3. The rubber panel of claim 1, wherein the first portion of each attachment protrusion is substantially rectangular and the second portion of each attachment protrusion is substantially circular.

4. The rubber panel of claim 1, wherein the first portion of each attachment protrusion comprises a substantially hexagonal cross-section.

5. The rubber panel of claim 1, wherein the securement lip of the first portion of each attachment protrusion is continuous.

6. The rubber panel of claim 1, wherein the upper edge of the elongated body comprises an upper curved lip.

7. The rubber panel of claim 1, wherein the lower edge of the elongated body comprises a lower curved lip.

8. The rubber panel of claim 1, wherein the first end of the elongated body is rounded.

9. The rubber panel of claim 1, wherein the second end of the elongated body is rounded.

10. The rubber panel of claim 1, wherein the first portion of each attachment protrusion has sides that are substantially parallel in plan view for mating engagement with the keyholes of a rail system and extends from the second portion of each attachment protrusions.

11. The rubber panel of claim 1 wherein each attachment protrusion has a hollow central portion.

12. A rubber panel attachable to rectangular holes of a rail system of a firearm, the rectangular holes having rounded corners for attachment of accessory mounting rails or mounts or accessories, the rubber panel comprising:

an elongated body comprising a first side, a second side, an upper edge, a lower edge, a first end, and a second end;

a gripping surface disposed on the first side of the elongated body;

a plurality of rectangular attachment protrusions with rounded corners disposed on the second side of the elongated body, with each attachment protrusion comprising a rectangular portion having a rectangular dimension in plan view, the rectangular portion being upwardly extending and disposed around the entire perimeter of a respective attachment protrusion for mating engagement with the rail system of the firearm; and the rectangular portion having inwardly deformable inner and outer surfaces, and having inwardly tapered guide surfaces disposed on the outer surfaces thereof, thereby to guide the respective attachment protrusion into a respective rectangular hole and to facilitate insertion and attachment of the respective attachment protrusion to the rail system; and the rectangular portion having a continuous securement lip unitarily formed with the inwardly tapered guide surfaces and laterally extending from the rectangular portion of the respective attachment protrusion and disposed about the entire perimeter of the respective attachment protrusion for mating and engagement with the respective rectangular hole of the rail system upon insertion of the respective attachment protrusion thereinto.

* * * * *